US007310909B2

(12) United States Patent
Broel et al.

(10) Patent No.: US 7,310,909 B2
(45) Date of Patent: Dec. 25, 2007

(54) SILK FLOWER HOLDER

(75) Inventors: David J. Broel, Marietta, GA (US); Ruby E. Broel, Marietta, GA (US)

(73) Assignee: D.R. Broel, Inc., Marietta, GA (US)

( * ) Notice: Subject to any disclaimer, the term of this patent is extended or adjusted under 35 U.S.C. 154(b) by 75 days.

(21) Appl. No.: 11/368,941

(22) Filed: Mar. 6, 2006

(65) Prior Publication Data

US 2006/0196113 A1 Sep. 7, 2006

Related U.S. Application Data

(60) Provisional application No. 60/658,466, filed on Mar. 7, 2005.

(51) Int. Cl.
*A47G 7/00* (2006.01)
*A47G 7/07* (2006.01)

(52) U.S. Cl. ..... 47/41.1; 47/41.11; 47/41.13; 248/27.8

(58) Field of Classification Search ..... 47/41.1, 47/41.11, 41.12, 41.13, 41.01, 41.14, 41.15; 248/27.8; 206/423
See application file for complete search history.

(56) References Cited

U.S. PATENT DOCUMENTS 809,172 A * 1/1906 Burdick ..... 47/41.01
1,439,143 A * 12/1922 Buss ..... 47/41.1
1,539,153 A * 5/1925 Bennett ..... 47/41.11
1,562,992 A * 11/1925 Schling ..... 47/41.11
1,855,719 A * 4/1932 Main ..... 47/41.01
3,474,568 A * 10/1969 Gallo ..... 47/55
D230,408 S * 2/1974 Persson-Melin ..... D11/147
4,203,180 A * 5/1980 Striplin ..... 24/17 B
5,454,189 A * 10/1995 Graham et al. ..... 47/41.12
6,095,480 A * 8/2000 Mutschler ..... 248/524
6,457,276 B1 * 10/2002 Masters ..... 47/41.01
D490,746 S * 6/2004 Broel ..... D11/146
7,165,356 B1 * 1/2007 Broel ..... 47/41.01
2002/0195366 A1 * 12/2002 Castleberry ..... 206/423

FOREIGN PATENT DOCUMENTS

EP 95385 A2 * 11/1983
EP 427637 A1 * 5/1991
EP 896808 A1 * 2/1999 ..... 451/242
FR 2620591 A1 * 3/1989
IE 095385 A2 * 11/1983 ..... 47/41.12

* cited by examiner

*Primary Examiner*—Michael J. Carone
*Assistant Examiner*—Kristen C Hayes
(74) *Attorney, Agent, or Firm*—Rodgers & Rodgers

(57) ABSTRACT

A holder for silk flowers including multiple extensions extending laterally outwardly of the holder, a pair of spaced discs respectively interconnected with the inner surface of the holder, a pair of apertures formed respectively in the discs, and multiple pointed prongs extending from the lower disc and into the aperture formed therein.

8 Claims, 2 Drawing Sheets

SILK FLOWER HOLDER

The benefits under 35 U.S.C. 119 are claimed of provisional patent application 60/658,466 filed Mar. 7, 2005.

BACKGROUND OF THE INVENTION

This invention relates to cemetery flower holders. Generally, cemetery flowers are displayed in a brass or similar type vessel which is affixed to a gravesite memorial. Typically, silk flowers are inserted into a cone-shaped foam insert which is then placed into the flower vessel. If the foam insert is too large, it must be reduced in size by carving away the excess material. If the holder is too small, the entire flower assembly is prone to be blown away by high winds or it simply floats upwardly when the flower container fills with water.

SUMMARY OF THE INVENTION

A holder for silk flowers having multiple extensions extending outwardly therefrom, at least one disc positioned in a groove formed on the interior of the holder, an aperture formed in the disc, and at least one prong projecting from the disc and into the aperture.

BRIEF DETAILED DESCRIPTION OF THE INVENTION

Figure 1:
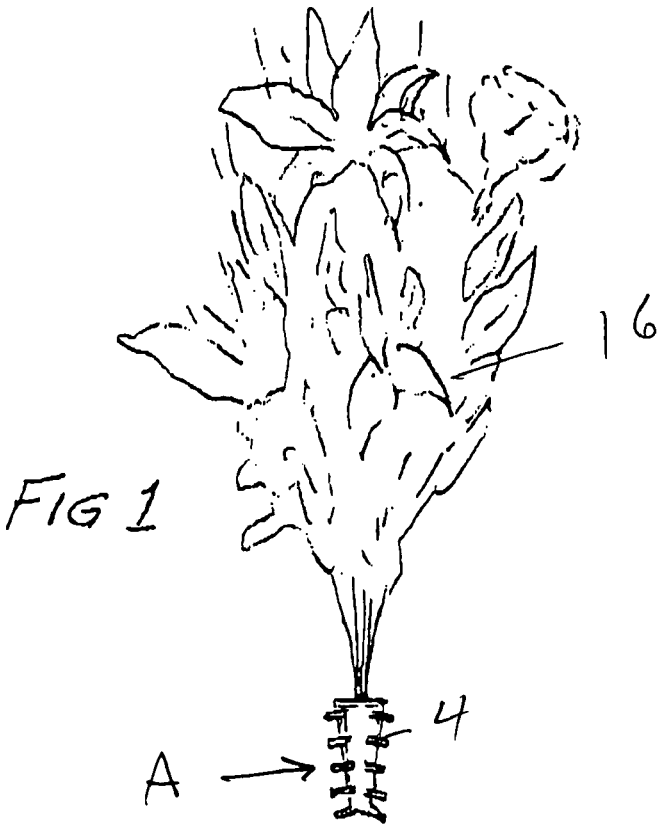
FIG. 1 is a perspective view of a silk flower holder according to this invention.
Figure 2:
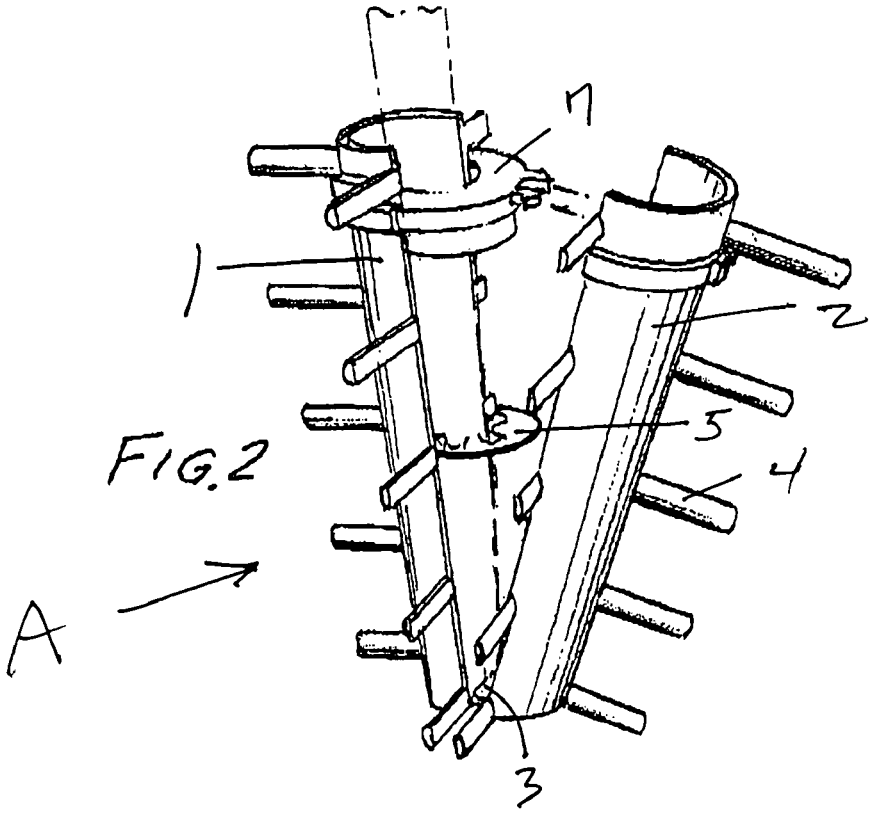
FIG. 2 is an enlarged perspective view showing details of the flower holder.

With reference to the drawings and with particular reference to FIG. 1, the basic structure of the flower holder is shown and includes a pair of generally semicircular base elements 1 and 2 which are foldably joined at connecting joint 3 and combine to form the holder generally identified by the letter A. Multiple flexible laterally projecting extensions 4 extend outwardly from each of the base elements 1 and 2.

According to this invention, lower disc 5 is provided and is adapted to be positioned in groove 6 formed on the inner surface of base elements 1 and 2 and is positioned approximately in the middle between the top and bottom of holder A. Also, according to this invention, upper disc 7 is adapted to be secured to the upper portion of holder A by means of a pair of flexible fasteners 8 and 9 which are insertable into locking apertures 10 and 11, respectively.

Figure 4:
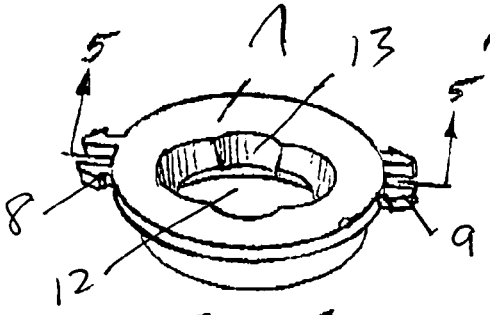
FIG. 4 is an enlarged perspective of the upper disc according to this invention.
Figure 5:
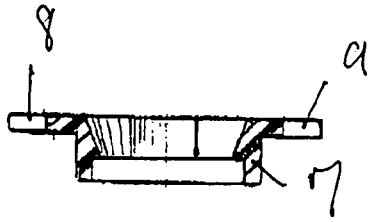
FIG. 5 is a cross-sectional view taken along line 5-5 in FIG. 4.
Figure 6:
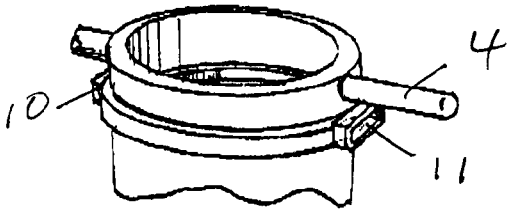
FIG. 6 is an enlarged perspective view of the upper portion of the holder.
Figure 7:
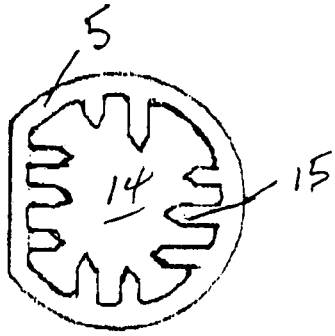
FIG. 7 is a plan view of the lower disc according to this invention.

As best shown in FIG. 4, upper disc 7 includes aperture 12 formed therein. Formed in upper disc 7 and around the periphery of aperture 12 are multiple beveled scallops 13. The details of lower disc 5 are illustrated in FIG. 7 wherein aperture 14 is formed in lower disc 5 with multiple prongs 15 extending inwardly of lower disc 5 around the periphery of aperture 14. Prongs 15 are of varying lengths with each having a pointed end. Lower disc 5 is generally formed of metal or other like flexible material.

In order to form the silk flower holder according to this invention, base elements 1 and 2 are initially opened to allow for the insertion of lower disc 5 into groove 6 and the placement of flexible fastener 8 of upper disc 7 into corresponding aperture 10 such that fastener 8 is initially compressed and then allowed to expand into an interlocked relationship with base element 1. Base elements 1 and 2 are then rotated about connecting joint 3 such that lower disc 5 is inserted into the portion of groove 6 formed in base element 2. Similarly, flexible fastener 9 is inserted through aperture 11 of base element 2 and into an interlocked relationship therewith, as is well known.

Figure 3:
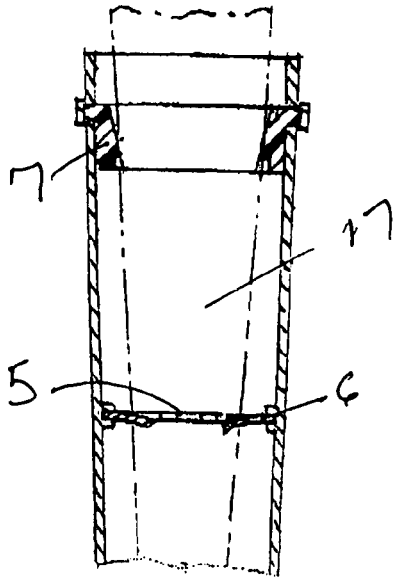
FIG. 3 is a sectional view showing a silk flower stalk disposed in the holder.
Figure 8:
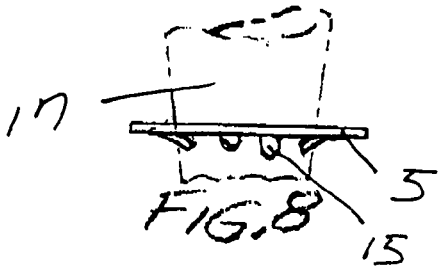
FIG. 8 is a side elevational view showing the operation of the lowered disc.
Figure 1:
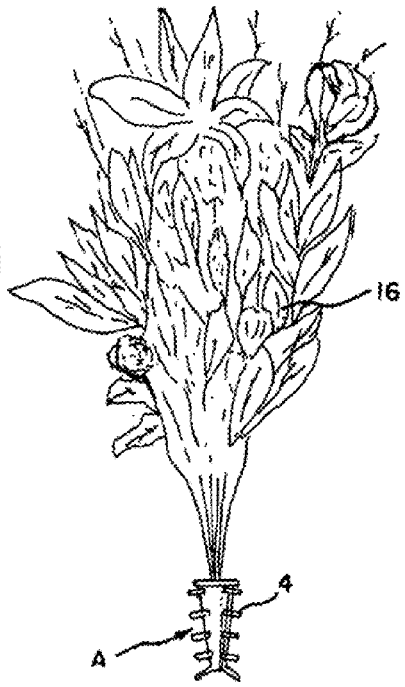
Figure 2:
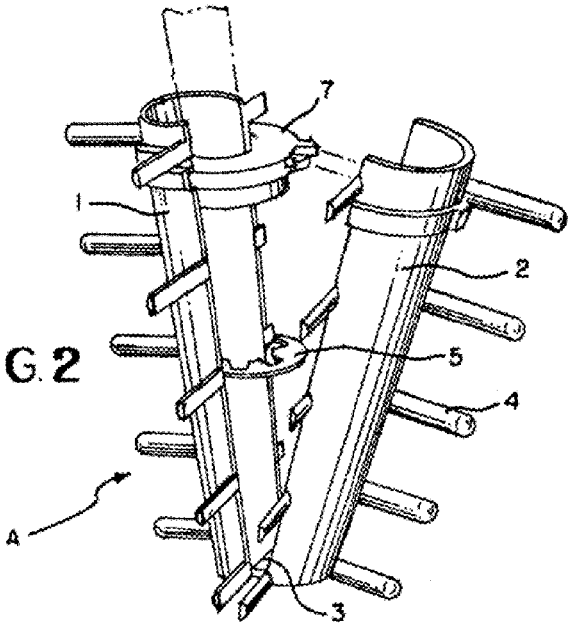
Figure 3:
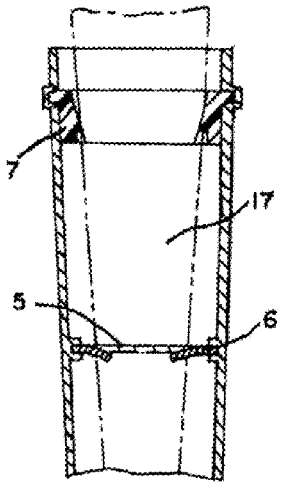
Figure 4:
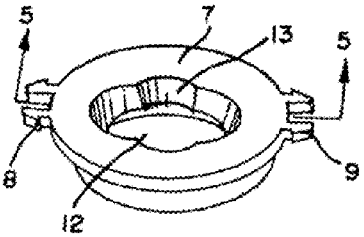
Figure 5:
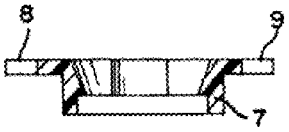
Figure 6:
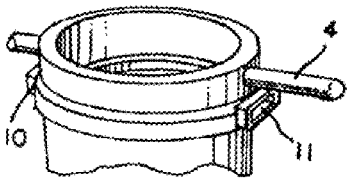
Figure 7:
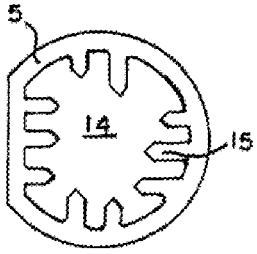
Figure 8:
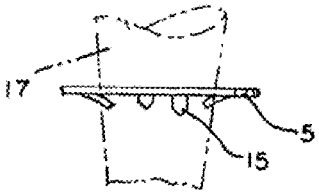

In order to complete the flower holder arrangement, an arrangement of flowers 16 is gathered together with the stems wrapped in tape or other suitable material so as to form flower arrangement stalk 17. As shown generally in FIG. 3, flower arrangement stalk 17 is inserted into holder A and initially through aperture 12 and then through aperture 14. When the stalk is inserted through aperture 14 of lower disc 5, prongs 15 are caused to flex downwardly, as shown in FIG. 8, and because the ends of prongs 15 are pointed, any upward movement of stalk 17 causes prongs 15 to be forced into stalk 17. By this means, any tendency for flowers 16 to inadvertently disengage from the holder is prevented. Also, the varying lengths of prongs 15 allows for the accommodation of flower arrangement stalks 17 of differing diameters.

As shown in FIG. 4, the aperture 12 is generally oval-shaped. Therefore, when flower arrangement stalk 17 is of a generally large diameter, stalk 17 is inserted through the middle of aperture 12 where the diameter of aperture 12 is the greatest. Upper disc 7 is also adapted for use in connection with a pair flower arrangement stalks 17 whereby they are placed side by side and then inserted through aperture 12 generally at the ends of oval-shaped aperture 12 and where the size of the opening is less than in the middle of aperture 12. Also, the beveled shape of scallops 13 enhances the insertion operation as stalks 17 are inserted through aperture 12.

The flower holder then appears as shown in FIG. 1 wherein it is inserted into a cemetery flower vessel and, since extensions 4 are of a length greater than the inside dimension of the vessel, extensions 4 are caused to flex vertically which causes holder A to be securely retained within the vessel.

Therefore, by this invention, a silk flower holder is provided which is held securely within a cemetery flower vessel and wherein the silk flowers are completely prevented from withdrawal from the holder.

The invention claimed is:

1. A flower holder comprising a holder, multiple flexible extensions extending outwardly from said holder, a groove formed around the inner surface of said holder, a planar disc disposed in said groove, an aperture formed in said disc, at least one planar prong extending from said disc into said aperture, a locking aperture formed in said holder adjacent the upper end thereof, a second disc including a fastener formed on the outer edge thereof, said fastener being in locking engagement with said locking aperture, and an aperture formed in said second disc.

2. A flower holder according to claim 1 wherein multiple prongs extend from said disc into said aperture and wherein said prongs are pointed.

3. A flower according to claim 2 wherein said prongs are of varying lengths.

4. A flower holder according to claim 1 wherein multiple scallops are formed on said second disc around the periphery of said second aperture and wherein said scallops are beveled.

5. A flower holder and flower arrangement combination comprising a holder, flexible elongated extensions extending outwardly from said holder, a groove extending around the inner surface of said holder, a planar flexible disc disposed in said groove, an aperture formed in said disc, at least one prong extending from said disc into said aperture, an upper disc spaced above said planar disc, a second aperture formed in said upper disc, and multiple beveled scallops formed on said upper disc around the periphery of said second aperture.

6. A combination according to claim 5 wherein said flower arrangement comprises multiple flowers with the stem of said flowers secured together to form a flower arrangement stalk.

7. A combination according to claim 6 wherein said stalk extends through both of said apertures.

8. A combination according to claim 7 wherein said stalk is in contact with said scallops and wherein said prong extends into said stalk.

* * * * *

UNITED STATES PATENT AND TRADEMARK OFFICE

CERTIFICATE OF CORRECTION

PATENT NO. : 7,310,909 B2
APPLICATION NO. : 11/368941
DATED : December 25, 2007
INVENTOR(S) : David J. Broel and Ruby E. Broel It is certified that error appears in the above-identified patent and that said Letters Patent is hereby corrected as shown below:

Delete Drawing Sheets 1 and 2 and substitute the formal drawings attached.

Title Page
The title page should be deleted and substitute therefor the attached title page.

Signed and Sealed this

Twenty-ninth Day of April, 2008

JON W. DUDAS
*Director of the United States Patent and Trademark Office*

(12) United States Patent
Broel et al.

(10) Patent No.: US 7,310,909 B2
(45) Date of Patent: Dec. 25, 2007

(54) SILK FLOWER HOLDER

(75) Inventors: David J. Broel, Marietta, GA (US); Ruby E. Broel, Marietta, GA (US)

(73) Assignee: D.R. Broel, Inc., Marietta, GA (US)

( * ) Notice: Subject to any disclaimer, the term of this patent is extended or adjusted under 35 U.S.C. 154(b) by 75 days.

(21) Appl. No.: 11/368,941

(22) Filed: Mar. 6, 2006

(65) Prior Publication Data

US 2006/0196113 A1 Sep. 7, 2006

Related U.S. Application Data

(60) Provisional application No. 60/658,466, filed on Mar. 7, 2005.

(51) Int. Cl.
*A47G 7/00* (2006.01)
*A47G 7/07* (2006.01)

(52) U.S. Cl. ..... 47/41.1; 47/41.11; 47/41.13; 248/27.8

(58) Field of Classification Search ..... 47/41.1, 47/41.11, 41.12, 41.13, 41.01, 41.14, 41.15, 248/27.8; 206/423
See application file for complete search history.

(56) References Cited

U.S. PATENT DOCUMENTS

| | | | | | |
|---|---|---|---|---|---|
| 809,172 | A * | 1/1906 | Burdick | 47/41.01 |
| 1,439,143 | A * | 12/1922 | Buss | 47/41.1 |
| 1,539,153 | A * | 5/1925 | Bennett | 47/41.11 |
| 1,562,992 | A * | 11/1925 | Schling | 47/41.11 |
| 1,855,719 | A * | 4/1932 | Main | 47/41.01 |
| 3,474,568 | A * | 10/1969 | Gallo | 47/55 |
| D230,408 | S * | 2/1974 | Persson-Melin | D11/147 |
| 4,203,180 | A * | 5/1980 | Striplin | 24/17 B |
| 5,454,189 | A * | 10/1995 | Graham et al. | 47/41.12 |
| 6,095,480 | A * | 8/2000 | Mutschler | 248/524 |
| 6,457,276 | B1 * | 10/2002 | Masters | 47/41.01 |
| D490,746 | S * | 6/2004 | Broel | D11/146 |
| 7,165,356 | B1 * | 1/2007 | Broel | 47/41.01 |
| 2002/0195366 | A1 * | 12/2002 | Castleberry | 206/423 |

FOREIGN PATENT DOCUMENTS

| | | | | |
|---|---|---|---|---|
| EP | 95385 | A2 * | 11/1983 | |
| EP | 427637 | A1 * | 5/1991 | |
| EP | 896808 | A1 * | 2/1999 | 451/242 |
| FR | 2620591 | A1 * | 3/1989 | |
| IE | 095385 | A2 * | 11/1983 | 47/41.12 |

* cited by examiner

*Primary Examiner*—Michael J. Carone
*Assistant Examiner*—Kristen C Hayes
(74) *Attorney, Agent, or Firm*—Rodgers & Rodgers

(57) ABSTRACT

A holder for silk flowers including multiple extensions extending laterally outwardly of the holder, a pair of spaced discs respectively interconnected with the inner surface of the holder, a pair of apertures formed respectively in the discs, and multiple pointed prongs extending from the lower disc and into the aperture formed therein.

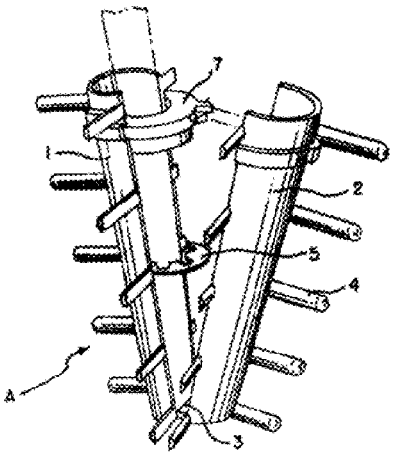

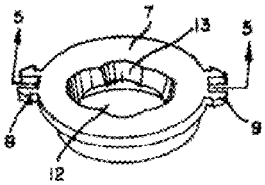

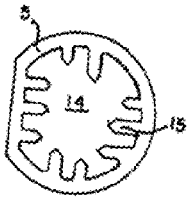

8 Claims, 2 Drawing Sheets